US009515769B2

(12) United States Patent
DiStasio

(10) Patent No.: US 9,515,769 B2
(45) Date of Patent: Dec. 6, 2016

(54) METHODS AND SYSTEMS FOR EXPLOITING SENSORS OF OPPORTUNITY

(71) Applicant: SRC, Inc., North Syracuse, NY (US)

(72) Inventor: Marcello M. DiStasio, Syracuse, NY (US)

(73) Assignee: SRC, INC., North Syracuse, NY (US)

( * ) Notice: Subject to any disclaimer, the term of this patent is extended or adjusted under 35 U.S.C. 154(b) by 0 days.

(21) Appl. No.: 14/215,608

(22) Filed: Mar. 17, 2014

(65) Prior Publication Data

US 2014/0273878 A1 Sep. 18, 2014

(51) Int. Cl.
*H04K 3/00* (2006.01)

(52) U.S. Cl.
CPC ..... *H04K 3/822* (2013.01); *H04K 2203/12* (2013.01); *H04K 2203/14* (2013.01)

(58) Field of Classification Search
CPC ..... H04K 2203/12
USPC ..... 455/67.11, 67.13, 412.1, 412.2, 452.1
See application file for complete search history.

(56) References Cited

U.S. PATENT DOCUMENTS

| | | | | |
|---|---|---|---|---|
| 7,113,090 | B1 | 9/2006 | Saylor et al. | |
| 7,202,797 | B2 | 4/2007 | Zhavi | |
| 7,671,728 | B2 | 3/2010 | Buehler | |
| 7,973,656 | B2 | 7/2011 | Ishidera | |
| 7,982,609 | B2 | 7/2011 | Padmanabhan et al. | |
| 8,031,068 | B1 | 10/2011 | Steadman et al. | |
| 8,045,482 | B2 * | 10/2011 | Davis et al. | 370/254 |
| 8,761,355 | B2 * | 6/2014 | Reding et al. | 379/88.12 |
| 8,886,167 | B2 * | 11/2014 | Aso et al. | 455/412.1 |
| 2006/0033625 | A1 | 2/2006 | Johnson et al. | |
| 2007/0256105 | A1 | 11/2007 | Tabe | |
| 2008/0007445 | A1 | 1/2008 | Leach, Jr. et al. | |
| 2008/0252445 | A1 * | 10/2008 | Kolen | G08B 21/0446 340/539.16 |
| 2008/0309482 | A1 | 12/2008 | Asplund et al. | |
| 2009/0054028 | A1 | 2/2009 | Denning, Jr. et al. | |
| 2009/0185036 | A1 | 7/2009 | Bowron | |

(Continued)

FOREIGN PATENT DOCUMENTS

| | | |
|---|---|---|
| EP | 2189957 | 5/2010 |
| GB | 2420242 | 5/2006 |

(Continued)

OTHER PUBLICATIONS

Abidi et al., Survey and Analysis of Multimodal Sensor Planning and Integration for Wide Area Surveillance, ACM Computing Surveys (CSUR) [Online] Dec. 2008, vol. 41, Issue 1, Article 7, pp. 1-36.

(Continued)

*Primary Examiner* — Tuan H Nguyen
(74) *Attorney, Agent, or Firm* — Bond Schoeneck & King, PLLC; George McGuire; Blaine Bettinger

(57) ABSTRACT

A method for obtaining sensor data about a remote target using one or more pre-existing sensors located in the vicinity of the remote target. The method includes the steps of identifying a remote target of interest, identifying one or more pre-existing target systems with one or more sensors located in the vicinity of the remote target, instructing the identified sensors to obtain sensor data and transmit the data over a communications network without detection, receiving the transmitted sensor data, and analyzing the received sensor data to create information about the remote target.

18 Claims, 2 Drawing Sheets

(56) References Cited

U.S. PATENT DOCUMENTS

Figure 1:
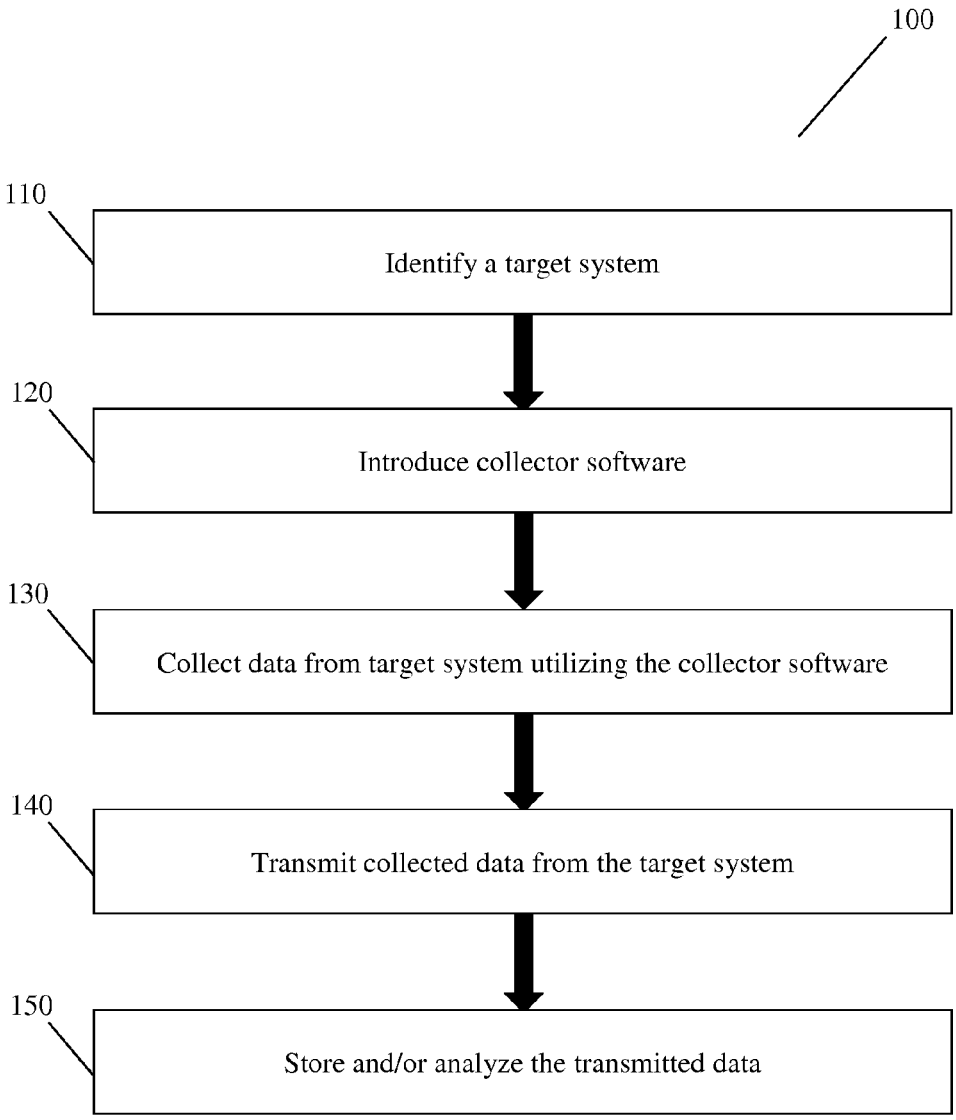

| | | | | |
|---|---|---|---|---|
| 2009/0262189 | A1 | 10/2009 | Marman | |
| 2010/0097182 | A1 | 4/2010 | Niktash et al. | |
| 2010/0134285 | A1 | 6/2010 | Holmquist | |
| 2010/0246669 | A1 | 9/2010 | Harel | |
| 2011/0001657 | A1 | 1/2011 | Fox et al. | |
| 2011/0080267 | A1 | 4/2011 | Clare et al. | |
| 2011/0171912 | A1* | 7/2011 | Beck et al. | 455/67.11 |
| 2011/0224950 | A1 | 9/2011 | Sieracki | |

FOREIGN PATENT DOCUMENTS

| | | |
|---|---|---|
| GB | 2475578 | 5/2011 |
| TW | 201023105 | 6/2010 |

OTHER PUBLICATIONS

Intel—Surveillance and Target Identification—Tactical Remote Sensor Systems System-of-Systems (TRSS SoS), http://www.marcorsyscom.usmc.mil/sites/cins/INTEL/SURVEILLANCE%20&%20TARGET%20IDENTIFICATION/TRSS.html (accessed Mar. 23, 2012), pp. 1-3.

Mobgraber et al., An Architecture for a Task-Oriented Surveillance System, 2010 Fifth International Conference on Systems (ICONS) [Online] 2010, pp. 146-151.

globalsecurity.org, Remote Battlefield Sensor System (REMBASS), Improved Remote Battlefield Sensor System (IREMBASS). http://www.globalsecurity.org/military/systems/ground/rembass.htm (accessed Mar. 23, 2012), pp. 1-4.

Northrop Grumman, Scorpion—Unattended Target Recognition Systems. http://www.es.northropgrumman.com/solutions/scorpion/assets/scorpion.pdf (accessed Mar. 23, 2012), pp. 1-2.

Sun et al, Activity Recognition on an Accelerometer Embedded Mobile Phone with Varying Positions and Orientations, UIC 2010 Proceedings of the 7th international conference on Ubiquitous intelligence and computing [Online] 2010, pp. 548-562.

Van Kasteren et al, Accurate Activity Recognition in a Home Setting, UbiComp '08 Proceedings of the 10th international conference on Ubiquitous computing [Online] 2008, pp. 1-9.

* cited by examiner

METHODS AND SYSTEMS FOR EXPLOITING SENSORS OF OPPORTUNITY

CROSS-REFERENCE TO RELATED APPLICATIONS

This application claims priority to U.S. Provisional Patent Application Ser. No. 61/792,500, filed on Mar. 15, 2013 and entitled "Methods and Systems For Exploiting Sensors of Opportunity," the entire disclosure of which is incorporated herein by reference.

BACKGROUND

The present invention relates to methods and systems for predictive analysis in a sensor environment, and, more particularly, to methods and systems for exploiting a wide variety of available sensors for passive detection and monitoring.

Remote detection and monitoring is a branch of signals intelligence, and typically entails active methods and systems. This active surveillance often involves, for example, transmission of an interrogating probe (e.g., acoustic, electromagnetic, optical, etc.) into the space of interest. This type of surveillance is overt, intrusive and detectable, all of which are undesirable for most surveillance applications, which typically desire to remain covert. In addition, most active methods require special purpose hardware and software. For example, electromagnetic domain ultra wideband ("UWB")-based techniques radiate high repetition rate electromagnetic pulses into an interrogation space and process the reflected energy. UWB requires complex, sophisticated, and expensive hardware and signals processing systems, is still in the test and development phase, and most importantly is greatly hampered by regulatory spectrum management issues. Among these spectrum issues is the potential interference with Global Positioning and other signals.

Additionally, active surveillance and monitoring systems are often subject to tampering and/or blocking upon their detection. Indeed, not only does detection often defeat the purpose of the surveillance and monitoring, but it gives the surveyed the opportunity to block or tamper with the surveillance. Accordingly, there is a continued need for passive detection and monitoring methods and systems that are covert and do not require special purpose hardware.

BRIEF SUMMARY

In accordance with the foregoing objects and advantages, methods and systems for cyber-exploitation of sensors of opportunity embedded in or associated with digital platforms, including but not limited to computers, processors, phones, tablets, portable computing devices, handheld computing devices, and other electronic devices. Collector software monitors activity within the vicinity of the platform by exploiting the effect of people and their motion on sensors that are components in modern computing platforms, including native sensing to track elements that do not directly interact with the platforms but rather use electromagnetic, seismic, vibration, acoustic, and other phenomenon that influence the sensors to observe and/or infer effects in the vicinity of the exploited platform. The gathered information is transmitted via a communications network to a location remote from the sensor of opportunity for analysis.

According to an aspect, the method or system can observe, analyze, or process instantaneous and/or historical patterns of activity. According to another aspect is the ability to sense people and/or activity in a room even if the digital platform is not in use.

According to an aspect is a method for gathering sensor information from a target system comprising the steps of: (i) identifying one or more target systems for monitoring, where the target system is in vicinity of a target of interest about whom information is desired; (ii) introducing collector software to the target system, where the collector software enables and/or activates the target system to transmit sensor information over a wired or wireless communications network; (iii) receiving transmitted sensor information from the target system over a wired or wireless communications network, where the sensor information comprises data collected from one or more sensors internal to or associated with the target system, where the sensor is collecting information about the environment around the target system including individuals, environmental factors, and other elements; (iv) recording and analyzing transmitted data to create derivative information about the target system and/or the individual, environment, or other element in the vicinity of the target system. According to one embodiment, analyzing the transmitted data comprises gathering and clustering or integrating information from two or more target systems, each comprising one or more sensors. This can include, for example, two or more of the same type of sensor, or two or more different types of sensors.

According to an aspect is a system for gathering sensor information from a target system comprising: (i) one or more target systems for monitoring, where the target system is in vicinity of a target of interest about whom information is desired; (ii) collector software to the target system, where the collector software enables and/or activates the target system to transmit sensor information over a wired or wireless communications network; (iii) transmitted sensor information from the target system over a wired or wireless communications network, where the sensor information comprises data collected from one or more sensors internal to or associated with the target system, where the sensor is collecting information about the environment around the target system including individuals, environmental factors, and other elements; (iv) derivative information about the target system and/or the individual, environment, or other element in the vicinity of the target system, created by analyzing transmitted data. According to one embodiment, the transmitted data comprises information from two or more target systems, each comprising one or more sensors. This can include, for example, two or more of the same type of sensor, or two or more different types of sensors.

According to an aspect, a method for obtaining sensor data about a remote target using one or more pre-existing sensors located in the vicinity of the remote target comprises the steps of: (i) identifying a remote target of interest; (ii) identifying one or more pre-existing target systems located in the vicinity of the remote target, wherein the one or more target systems comprise one or more sensors; (iii) instructing the identified one or more sensors to obtain sensor data and transmit the obtained sensor data over a communications network without detection; (iv) receiving, over said communications network, said transmitted sensor data; and (v) analyzing the received sensor data to create information about said remote target.

According to an embodiment, the method further includes the step of storing the received sensor data prior to said analyzing step.

According to an embodiment, the instructing step includes the step of introducing to said one or more pre-existing target systems software comprising instructions.

According to an embodiment, the analyzing step comprises the step of integrating sensor data obtained from two or more of said pre-existing sensors.

According to an embodiment, the two or more of said pre-existing sensors comprises at least two different kinds of sensors.

According to an embodiment, the one or more pre-existing sensors located in the vicinity of the remote target are selected from the group consisting of a WiFi Network Interface Card, a Bluetooth transceiver, an accelerometer, a temperature sensor, a voltage sensor, a current sensor, a microphone, a camera, and combinations thereof.

According to an embodiment, the communications network is a wireless communications network.

According to an embodiment, the one or more pre-existing target systems is a computing device. According to an embodiment, the computing device is a handheld computing device.

According to an embodiment, the method further includes the step of modifying the one or more pre-existing target systems.

According to an aspect, a non-transitory computer-readable storage medium storing computer-executable instructions for performing the steps of: (i) identifying a remote target of interest; (ii) identifying one or more pre-existing target systems located in the vicinity of the remote target, wherein the one or more target systems comprise one or more sensors; (iii) instructing the identified one or more sensors to obtain sensor data and transmit the obtained sensor data over a communications network without detection; (iv) receiving, over said communications network, said transmitted sensor data; and (v) analyzing the received sensor data to create information about said remote target.

BRIEF DESCRIPTION OF THE SEVERAL VIEWS OF THE DRAWING(S)

Figure 2:
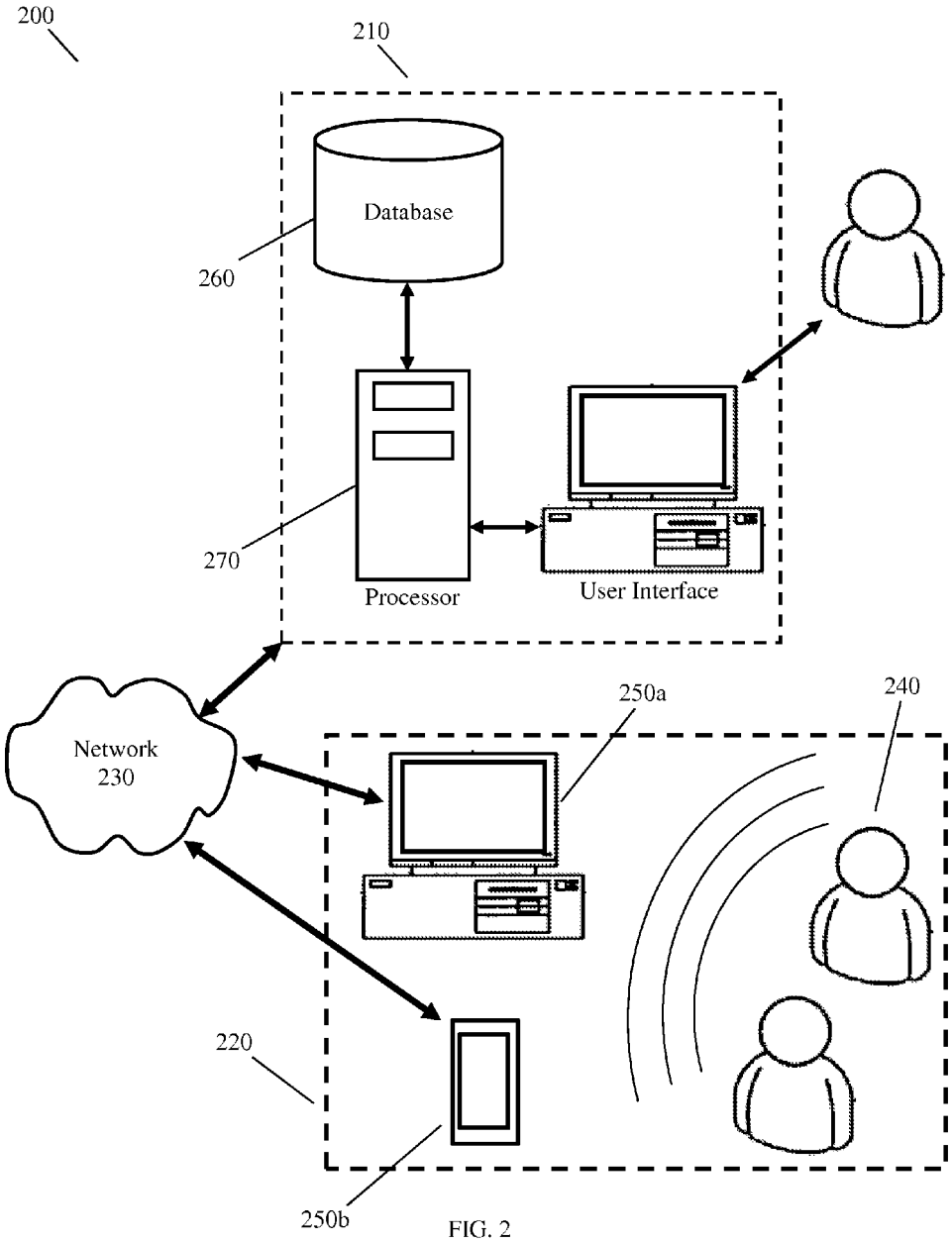

The present invention will be more fully understood and appreciated by reading the following Detailed Description in conjunction with the accompanying drawings, in which:

FIG. 1 is a flowchart showing a process for passive detection and monitoring using available sensors according to an embodiment of the present invention; and FIG. 2 is an architecture diagram of a system that is structured, configured, and/or programmed for detection and monitoring using available sensors according to an embodiment of the present invention.

DETAILED DESCRIPTION

The present invention will be more fully understood and appreciated by reading the following Detailed Description in conjunction with the accompanying drawings, wherein like reference numerals refer to like components.

In accordance with an embodiment of the present invention are provided computer systems in the field of signals intelligence, and more particularly, activity detection and monitoring computer systems for passively collecting and analyzing information about an individual, object, or location of interest using pre-existing sensors. According to an embodiment, the method and system can detect the person or item of interest even if the computer is not actively being used. Further, the user can infer environmental and operational information in the room, location, and/or region of interest, especially when a set of computers or digital devices are exploited simultaneously to act as a unique sensor network. The ability to remotely and covertly observe the environment of the workplace and/or living space of a target of interest in physically inaccessible areas is a tactical and strategic element in planning, adapting and executing a covert mission.

Referring to FIG. 2, a flow chart illustrating a method 200 for passively collecting and analyzing information about an individual, object, or location of interest using pre-existing sensors in accordance with an embodiment of the invention is disclosed. In step 210, an individual, object, or location of interest is identified, which in turn identifies the target system. This target of interest can be a person of interest, a location of interest such as a house, room, or other location, or can be an object of interest. The target of interest, therefore, is any target of interest capable of being identified or characterized in some way by the passive monitoring system. Once the individual, object, or location of interest is identified, the target system will be any system in proximity to the target of interest and capable of collecting information about the target of interest. The target system is preferably an existing sensor of opportunity embedded in or associated with one or more digital platforms, including but not limited to computers, processors, phones, tablets, portable computing devices, handheld computing devices, and other electronic devices. Sensors of opportunity that can be exploited include, but are not limited to, WiFi Network Interface Cards (NIC's), Bluetooth transceiver, embedded accelerometers, temperature sensors, voltage and current sensors that are elements of the internal power management system (e.g. ACPI), internal microphones, and cameras, among many, many others.

In step 120 of the method, collector software is introduced to the target system. Depicted in FIG. 2 is a passive information collection and monitoring system 200 including but not limited a monitoring component 210 and a monitored component 220. The two components are in communication by a network 230, which can be any suitable wired or wireless network capable of transmitting communication, including but not limited to a telephone network, Internet, Intranet, local area network, Ethernet, online communication, offline communications, wireless communications and/or similar communications method or means. Monitoring component 210 of the system is an entity with the goal of collecting information about monitored component 220. Similarly, monitored component 210 is any target capable of being identified or characterized in some way by the passive monitoring system, such as an individual, object, or location of interest. As just one example targets 240 are suspects in an investigation, and pursuant to a warrant the monitoring component 210—such as a state or federal investigative entity—is authorized to collect information about the targets 240 in the monitoring component of system 200.

Based on the identification of targets 240 for investigation, monitoring, or other surveillance, elements 250 are identified by the monitoring component or some other identification component as being the target system having one or more sensors of opportunity embedded in or associated with a digital platform. In the example depicted in FIG. 2, the target system comprising a sensor of opportunity is a computer 250*a* and a smartphone 250*b*. In other embodiments, the target system is a computer, processor, phone, tablet, portable computing device, handheld computing device, and/or some other electronic device, among many other components comprising one or more sensors of opportunity. The sensor of opportunity may be remote, such as a wireless weather station or wireless router that is configured to continuously or intermittently communicate with a computer.

Collector software is introduced or injected into target system 220 by any one of a wide variety of mechanisms. Collector software, preferably covert, monitors activity within the vicinity of the platform by exploiting the effect of people and their motion on sensors that are components in modern computing platforms, including native sensing to track elements that do not directly interact with the platforms but rather use electromagnetic, seismic, vibration, acoustic, and other phenomenon that influence the sensors to observe and/or infer effects in the vicinity of the exploited platform.

According to an embodiment, the collector software is any software that can, without detection by the target or individual of interest, interact with and/or obtain data from an existing sensor of opportunity embedded in or associated with one or more digital platforms, including but not limited to computers, processors, phones, tablets, portable computing devices, handheld computing devices, and other electronic devices, where the sensor of opportunity is, for example, a WiFi Network Interface Card (NIC), Bluetooth transceiver, embedded accelerometer, temperature sensor, voltage and current sensor that are elements of the internal power management system (e.g. ACPI), internal microphone, and/or camera, among many, many others. According to another embodiment, the collector software is detected by the target system comprising a sensor of opportunity, but the detection is not revealed to the individual of interest due to direct or indirect manipulation of the target system by the collector software or remotely by the monitoring component or individual. According to another embodiment is the ability to sense people and/or activity in a room even if the digital platform is not in use.

According to another embodiment, the target system is a server that is in communication with multiple digital platforms. In this system, the collector software is installed on the server, which then collects the sensor information from the communicating digital platforms. This might be an advantageous system where the server normally collects sensor information but does not natively transmit that sensor information, or only transmits the sensor information to a destination other than the remote surveillance.

According to an embodiment, the method and system uses native sensing to track elements that do not directly interact with the platforms but rather use electromagnetic, seismic, vibrational, acoustic and other phenomenon that influence the sensors to observe/infer effects in the vicinity of the exploited platform. This allows the user to observe instantaneous and/or historical patterns of activity of individuals and groups.

At or in the vicinity of the target, the target system(s) may require configuration or modification to comply with the requirements of the overall system. For example, there may be one or more initial setup tasks including, but not limited to: remote installation of the monitoring and/or surveillance software, and self-configuring to collect sensor data. There may also be a need to activate and/or deactivate certain aspects of the target system(s), including activating sensors or deactivating security software. One or more of these steps can be performed by the collector software.

At step 130, collector software collects data from the target system utilizing the one or more sensors of opportunity embedded in or associated with the target system 250. According to an embodiment, the collector software may activate one or more sensors of opportunity within the target system that are not normally activated, or are otherwise intermittent or dormant. The collector software may also enable the collection and storage of information that is not normally collected and stored by the target system. For example, a computer may detect temperature information in order to adapt to changes in temperature, but may not normally record temperature readings in memory over time. Collector software can enable the target system to store all temperature readings.

The target system may also include or require continuous and/or periodic operating tasks that are necessary for continued collection and sharing of information. For example, there might be continuous data collection from one or more of the sensors associated with the target system(s); feature extraction from data sets; aggregation and/or fusion of observations for inferencing; ongoing data logging; as well as periodic and/or triggered reporting of results, among other functions. One or more of these functions or tasks may also occur in whole or in part at the level of the monitoring component 210, as discussed below.

As one example, embedded accelerometer data is collected by collector software. Most laptops, smartphones, and many other personal and commercial electronics contain one or more accelerometers that continuously or periodically detect motion. The embedded accelerometer is an example of a sensor of opportunity, and the data may be utilized to characterize the environment around the sensor. For example, the data may reveal information about footsteps, HVAC system patterns, machinery operation, vehicular traffic detection, information about external conditions, as well as a wide variety of other conditions.

At step 140, the data collected by the collector software is transmitted via the wired or wireless network 230. For example, the collector software can direct the target system to continuously transmit the collected or identified information via the network whenever the network connection is available. Alternatively, the collector software can package and/or summarize the collected or identified information for transmission via the network at specified times or in response to predetermined or preprogrammed conditions. As an example, the collected sensor information may be covertly packaged along with non-covert information, such as an email, web browsing activity, or other online or network activity, and sent under cover of the non-covert activity to mask the transmission of the collected sensor information. To minimize detection, the collector software may reduce the size of the transmission by performing analysis, packaging, and/or summarization of the collected information prior to or during transmission. Alternatively, the collector software is manually collected covertly, or when covertness is no longer necessary.

At step 150, the data transmitted from monitored component 220 over network 230 is received by the monitoring component 210. The monitoring component can include one or more databases 260 in which the transmitted information or some derivative is stored, one or more processors 270 for analysis of the transmitted information. Analysis of the information can entail many different forms, including but not limited to simple screening for predetermined or preprogrammed criteria such as temperature, voice recognition, movement, activation, deactivation, or any one of a variety of simple triggers or criteria. The analysis can also involve more in-depth review of the data, including pattern detection or screening, spoken word screening, or any of a variety of analyses. According to one embodiment, the method or system can observe, analyze, or process instantaneous and/ or historical patterns of activity, based all or in part on previous analyses and/or stored information.

According to an embodiment, monitoring component 210 may include or require continuous and/or periodic tasks that are necessary for continued collection and analysis of information. For example, there might be: target selection/identification; surveillance software deployment; activation and deactivation; continuous and/or periodic collection from deployed collectors; and inferencing, identification, and situational assessments.

Monitoring component 210 may be or include any device capable of running, mirroring, displaying, or otherwise interacting with software required for elements of surveillance, including identifying the target, modifying the target, collecting transmitted sensor information, and analyzing transmitted sensor information. This includes, but is not limited to, desktops, laptops, tablets, personal digital assistants, personal digital devices, cellular phones, mobile computers, netbooks, smartphones, pocket computers, and handheld computers, among many others. In other words, monitoring component 210 may be any device comprising a processor and capable of a network connection. The monitoring component 210 may also comprise a database for storing sensor information and other types of information.

A "module" or "component" as may be used herein, can include, among other things, the identification of specific functionality represented by specific computer software code of a software program. A software program may contain code representing one or more modules, and the code representing a particular module can be represented by consecutive or non-consecutive lines of code.

As will be appreciated by one skilled in the art, aspects of the present invention may be embodied/implemented as a computer system, method or computer program product. The computer program product can have a computer processor or neural network, for example, that carries out the instructions of a computer program. Accordingly, aspects of the present invention may take the form of an entirely hardware embodiment, an entirely software embodiment, and entirely firmware embodiment, or an embodiment combining software/firmware and hardware aspects that may all generally be referred to herein as a "circuit," "module," "system," or an "engine." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction performance system, apparatus, or device.

The program code may perform entirely on the user's computer, partly on the user's computer, as a stand-alone software package, partly on the user's computer and partly on a remote computer, or entirely on the remote computer or server, among other locations. In the latter scenario, the remote computer may be connected to the user's computer through any type of network, including a local area network (LAN) or a wide area network (WAN), or the connection may be made to an external computer (for example, through the Internet using an Internet Service Provider).

The flowcharts/block diagrams in the Figures illustrate the architecture, functionality, and operation of possible implementations of systems, methods, and computer program products according to various embodiments of the present invention. In this regard, each block in the flowcharts/block diagrams may represent a module, segment, or portion of code, which comprises instructions for implementing the specified logical function(s). It should also be noted that, in some alternative implementations, the functions noted in the block may occur out of the order noted in the figures. For example, two blocks shown in succession may, in fact, be performed substantially concurrently, or the blocks may sometimes be performed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While several embodiments of the invention have been discussed, it will be appreciated by those skilled in the art that various modifications and variations of the present invention are possible. Such modifications do not depart from the spirit and scope of the present invention.

What is claimed is:

1. A method for obtaining sensor data about a remote target using one or more pre-existing sensors located in the vicinity of the remote target, the method comprising the steps of:

identifying a remote target of interest;

identifying one or more pre-existing target systems located in the vicinity of the remote target, wherein the one or more target systems comprise one or more sensors;

introducing without detection, to the one or more pre-existing target systems, installable software from a remote location, the installable software comprising instructions to obtain sensor data and transmit the obtained sensor data over a communications network without detection;

instructing, using the introduced installable software, the identified one or more sensors to obtain sensor data and transmit the obtained sensor data over a communications network without detection;

receiving, over said communications network, said transmitted sensor data;

analyzing the received sensor data to create information about said remote target.

2. The method of claim 1, further comprising the step of storing the received sensor data prior to said analyzing step.

3. The method of claim 1, wherein said analyzing step comprises the step of integrating sensor data obtained from two or more of said pre-existing sensors.

4. The method of claim 3, wherein said two or more of said pre-existing sensors comprises at least two different kinds of sensors.

5. The method of claim 1, wherein the one or more pre-existing sensors located in the vicinity of the remote target are selected from the group consisting of a WiFi Network Interface Card, a Bluetooth transceiver, an accelerometer, a temperature sensor, a voltage sensor, a current sensor, a microphone, a camera, and combinations thereof.

6. The method of claim 1, wherein the communications network is a wireless communications network.

7. The method of claim 1, wherein the one or more pre-existing target systems is a computing device.

8. The method of claim 7, wherein the computing device is a handheld computing device.

9. The method of claim 1, further comprising the step of modifying the one or more pre-existing target systems.

10. A non-transitory computer-readable storage medium storing computer-executable instructions for performing the following steps:

identifying a remote target of interest;

identifying one or more pre-existing target systems located in the vicinity of the remote target, wherein the one or more target systems comprise one or more sensors;

introducing without detection, to the one or more pre-existing target systems, installable software from a remote location, the installable software comprising instructions to obtain sensor data and transmit the obtained sensor data over a communications network without detection;

instructing the identified one or more sensors to obtain sensor data and transmit the obtained sensor data over a communications network without detection;

receiving, over said communications network, said transmitted sensor data; and analyzing the received sensor data to create information about said remote target.

11. The system of claim 10, further comprising the step of storing the received sensor data prior to said analyzing step.

12. The system of claim 10, wherein said analyzing step comprises the step of integrating sensor data obtained from two or more of said pre-existing sensors.

13. The system of claim 12, wherein said two or more of said pre-existing sensors comprises at least two different kinds of sensors.

14. The system of claim 10, wherein the one or more pre-existing sensors located in the vicinity of the remote target are selected from the group consisting of a WiFi Network Interface Card, a Bluetooth transceiver, an accelerometer, a temperature sensor, a voltage sensor, a current sensor, a microphone, a camera, and combinations thereof.

15. The system of claim 10, wherein the communications network is a wireless communications network.

16. The system of claim 10, wherein the one or more pre-existing target systems is a computing device.

17. The system of claim 16, wherein the computing device is a handheld computing device.

18. The system of claim 10, further comprising the step of modifying the one or more pre-existing target systems.

* * * * *